US006786853B2

(12) United States Patent
Wu et al.

(10) Patent No.: US 6,786,853 B2
(45) Date of Patent: Sep. 7, 2004

(54) REAR SAFETY FOOT REST OF A TREADMILL

(76) Inventors: Peter Wu, No.1, Lane 233, Sec.2, Charng Long Rd., Taiping (TW), 411; Leao Wang, No.1, Lane 233, Sec.2, Charng Long Rd., Taiping (TW), 411

( * ) Notice: Subject to any disclaimer, the term of this patent is extended or adjusted under 35 U.S.C. 154(b) by 18 days.

(21) Appl. No.: 10/305,471

(22) Filed: Nov. 29, 2002

(65) Prior Publication Data

US 2004/0106503 A1 Jun. 3, 2004

(51) Int. Cl.[7] ..... A63B 22/02
(52) U.S. Cl. ..... 482/54
(58) Field of Search ..... 482/51, 54, 908, 482/148

(56) References Cited

U.S. PATENT DOCUMENTS 5,711,745 A * 1/1998 Yang ..... 482/54

6,390,955 B1 * 5/2002 Wang et al. ..... 482/54

* cited by examiner

*Primary Examiner*—Nicholas D. Lucchesi
*Assistant Examiner*—Tam Nguyen
(74) *Attorney, Agent, or Firm*—Troxell Law Office PLLC; Kuo-Hsiung Chiu

(57) ABSTRACT

The present invention relates to a rear safety foot rest of a treadmill. The treadmill includes a main frame, a running bed, a front support unit and a rear support unit. Moreover, an electronic console and two handles are disposed on the main frame, while a running belt is wrapped around the running bed for an in-place rotation. In addition, the running bed is provided with a support unit coupled with a rear roller while a rear safety foot rest is fixed to the support unit. Consequently, when the tensity and the tightness of the running belt is adjusted by an adjusting spindle, the support unit and the running belt will be synchronically shifted with the rear roller so as to maintain the proper clearance between the rear safety foot rest and the running belt.

2 Claims, 4 Drawing Sheets

REAR SAFETY FOOT REST OF A TREADMILL

BACKGROUND OF THE INVENTION

1. Fields of the Invention

The present invention relates to a rear safety foot rest of a treadmill, and more particularly, to a device which is coupled with a rear roller so as to permanently keep the running belt off the rear plate with a proper clearance.

2. Description of the Prior Art

Some treadmills have a rear safety foot rest directly disposed behind the running belt of the treadmill for safety purpose. When the running speed of operator much slower than that of the running belt, the feet of the operator will be in contact with the fixed rear safety plate. Therefore, the operator can make an instinctive response by increasing his running speed or springing away from the running belt to avoid falling back to the ground.

U.S. Pat. No. 5,772,560 describes a small piece of rear safety foot rest fitted directly behind the running bed on a treadmill. In order to avoid contact of the rear safety foot rest with the running belt, the rear safety foot rest is kept off the running belt with a proper clearance. The existence of the clearance is used as adjusting range for rear roller which is hidden within the running belt and neighbors on the rear safety foot rest in a parallel state.

The adjustment of the tensity and tightness of the running belt through the rear roller enables a smooth rotation of the running belt and avoids being slipped away or deviated. The position adjustment of the rear roller easily causes a greater or smaller clearance or different clearance at both sides relative to the fixed rear safety foot rest. In other words, foreign bodies are easily into the gap when the clearance is too large. If the engaged foreign body is fingers, its result is too terrible to imagine. Also, it doesn't meet the safety requirements. If the clearance too small, the rear safety foot rest will rub against the running belt, thereby damaging components of the treadmill. The different clearance at both sides will cause a hindered rotation of the running belt and the above-mentioned ill effects. Furthermore, it affects the whole appearance of the treadmill, thereby giving the consumers a bad impression on the treadmill.

SUMMARY OF THE INVENTION

Therefore, it is a primary object of the present invention to eliminate the above-mentioned drawbacks and to provide a rear safety foot rest of a treadmill which can be synchronically moved with the adjustment of the real roller so as to permanently achieve an optimal clearance between the running belt and the rear safety foot rest

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
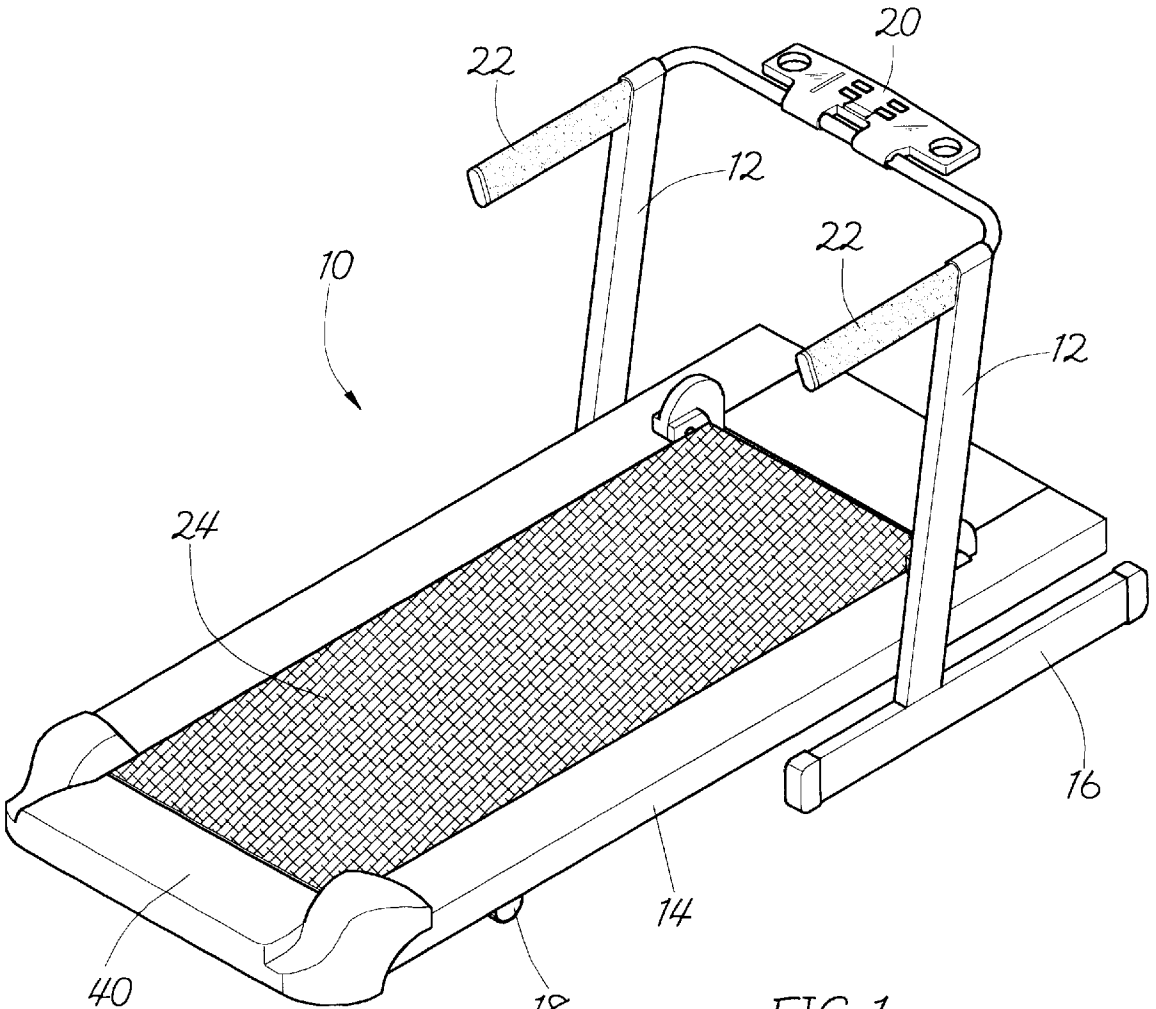
FIG. 1 is a perspective view of a preferred embodiment of the present invention.
Figure 2:
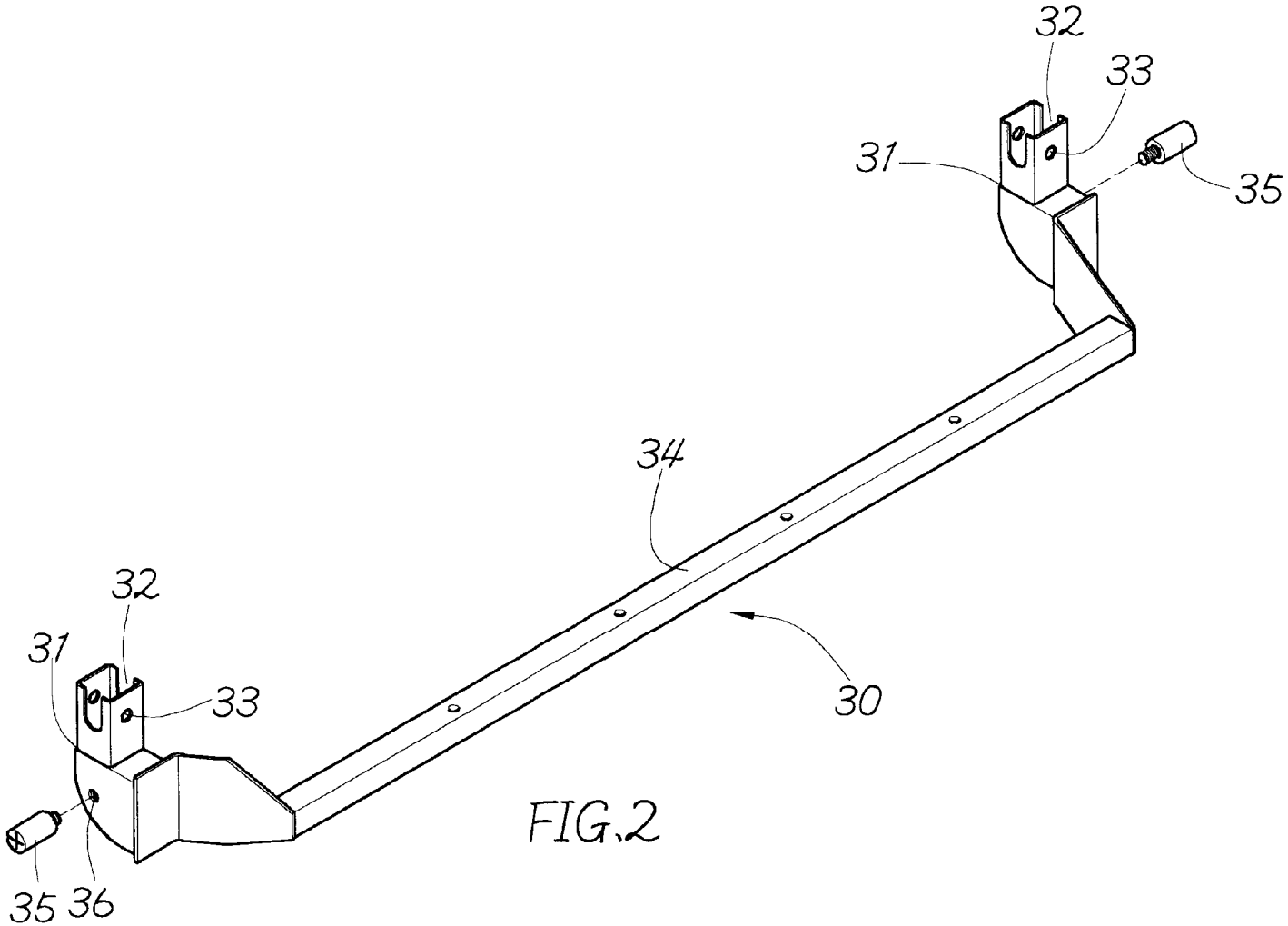
FIG. 2 is a perspective view of a support unit of the present invention.
Figure 3:
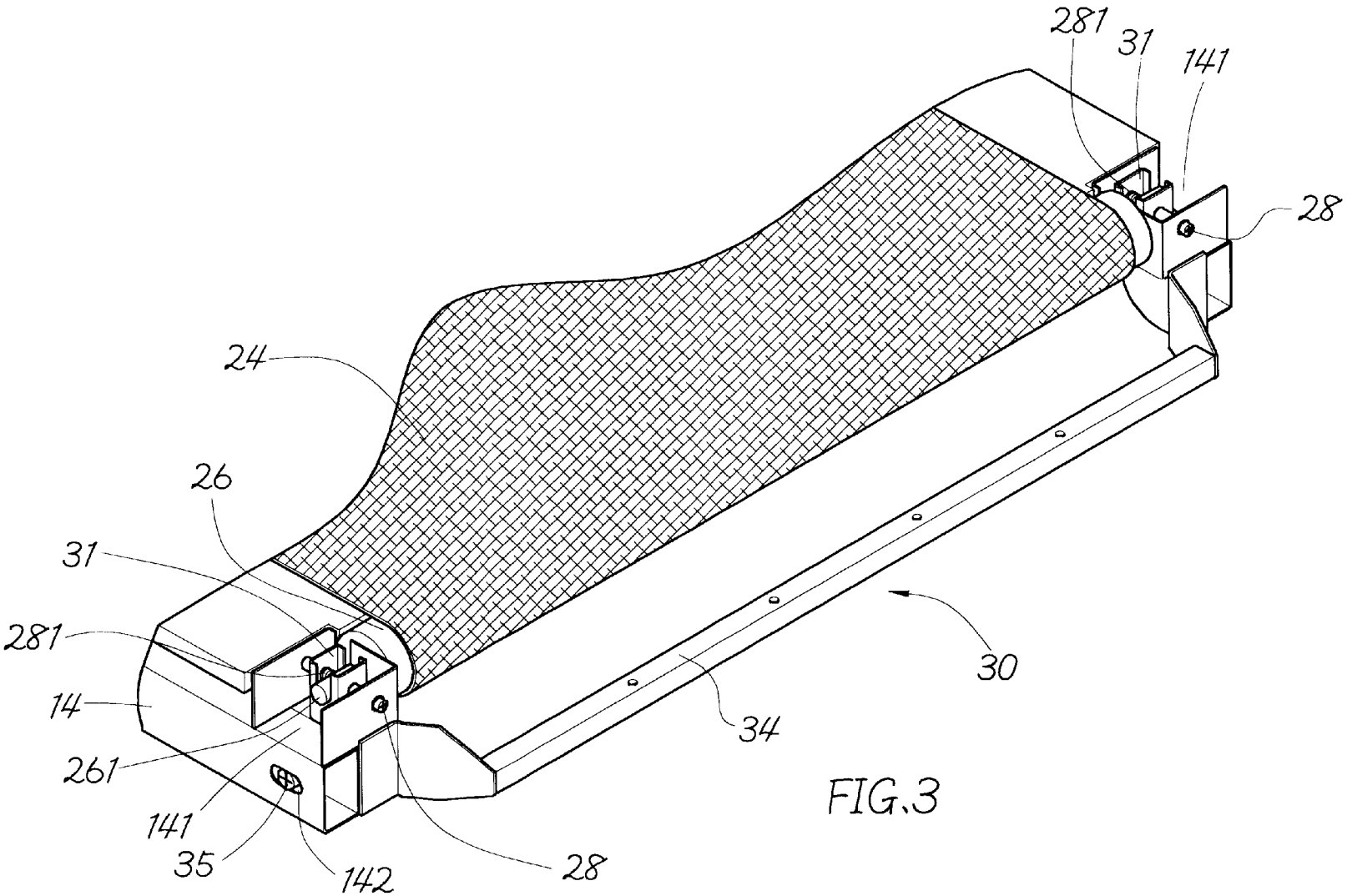
FIG. 3 is a perspective partial view in accordance with the preferred embodiment of FIG. 1 after removal of the rear safety foot rest.

First of all, referring to FIGS. 1, 2 and 3, a preferred embodiment of the present invention of a treadmill is shown. From the Figure, the treadmill 10 is made up of basic components that include a main frame 12, a running bed 14, a front support unit 16 and a rear support unit 18. Moreover, an electronic console 20 and two handles 22 are disposed on the main frame 12, while a running belt 24 is wrapped around the running bed 14 for an in-place rotation. In addition, the running bed 14 is provided with a support unit 30 coupled with a rear roller 26 while a rear safety foot rest 40 is fixed to the support unit 30. Consequently, when the tensity and the tightness of the running belt 24 is adjusted by an adjusting spindle 28, the support unit 30 and the running belt 24 will be synchronically shifted with the rear roller 26 so as to maintain the proper clearance between the rear safety foot rest 40 and the running belt 24.

The support unit 30 uses inserting members 31 at both sides thereof for inserting into the rear wheel seats 141 at both sides of the running bed 14 from the bottom to the top. Each of the inserting members 31 has a pair of lateral arched grooves 32 and a pair of longitudinal through holes 33 through which the shaft 261 of the rear roller 26 and the adjusting spindle 28 pass respectively. A connecting bar 34 is used to be secured with the rear safety foot rest 40. Moreover, the running bed 14 includes an open groove 142 disposed at both sides thereof respectively and corresponding to each of the inserting members 31 of the support unit 30. Thus, two positioning pins 35 are received therein and screwed into the corresponding threaded hole 36 for a firm fastening.

The adjustment of the adjusting spindle 28 and the rear roller 26 is carried out by screwing male thread 281 of the adjusting spindle 28 into female thread (not shown) of the shaft 261 of the rear roller 26. In other words, when the adjusting spindle 28 is rotated, the position thereof isn't changed while the rear roller 26 is moved. This belongs to the prior art so that no further descriptions are given hereinafter.

Figure 4:
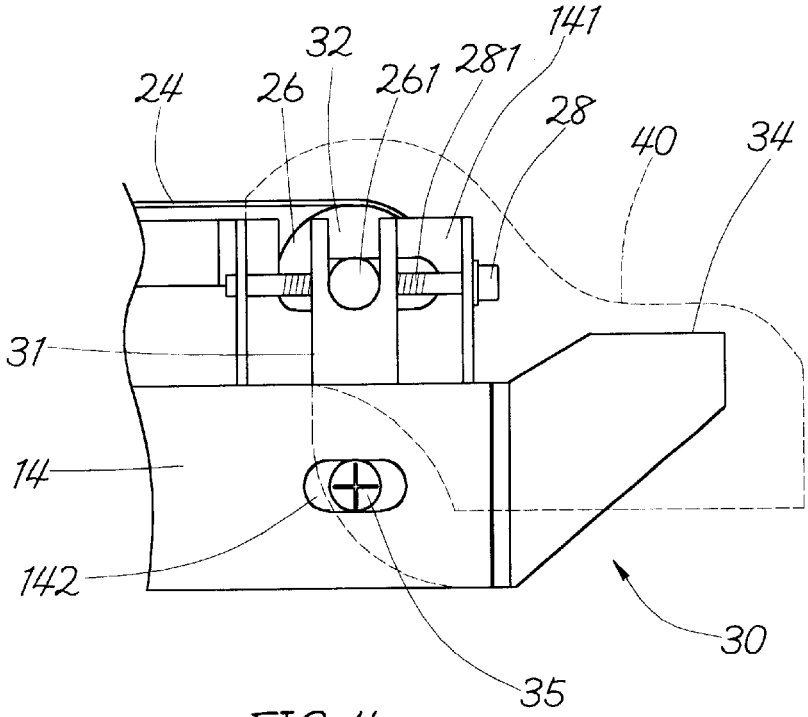
FIG. 4 is a side view of the preferred embodiment in accordance with FIG. 3, illustrating the slope of the running bed is adjusted.
Figure 5:
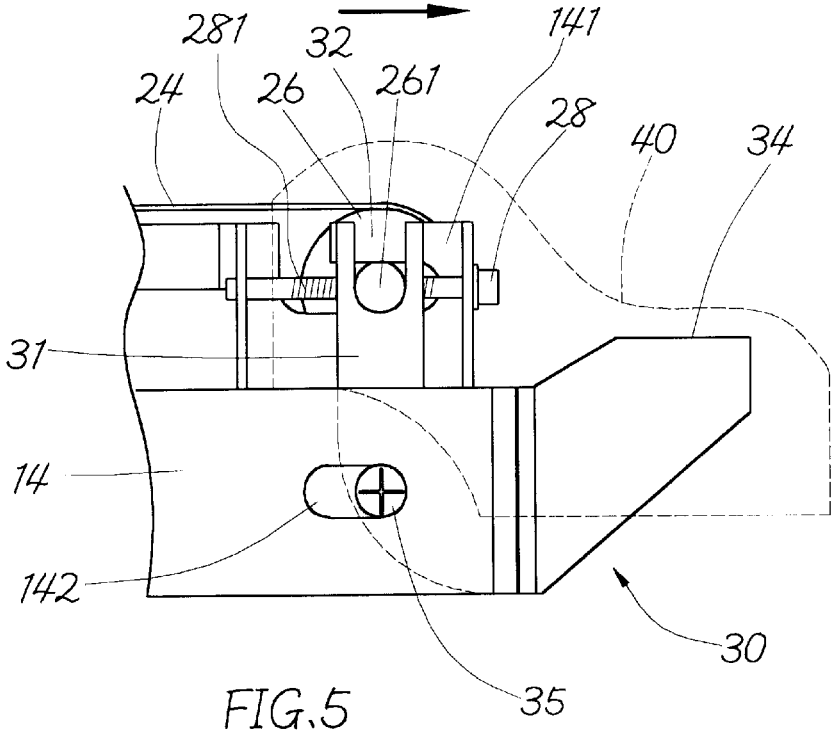
FIG. 5 is a schematic drawing of the preferred embodiment in accordance with FIG. 4, illustrating the operation thereof

As shown in FIGS. 4 and 5, in rotating the adjusting spindle 28 at either side of the running bed 14, the support unit 30 allows a great margin for adjusting the tensity and the tightness of the running belt 24. Certainly, the rear safety foot rest 40 makes a synchronic movement with the rear roller 26. Therefore, a proper clearance between the rear safety foot rest 40 and the running belt 24 can be maintained without the trouble of too great or too small clearance.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A treadmill comprising: a main frame; a running bed having a longitudinal axis; a front support unit and a rear support unit; an electronic console and two handles are located on the main frame; a running belt is wrapped around the running bed and a rear roller for an in-place rotation, and a safety footrest coupled to the rear of the treadmill, wherein, when a tensity and a tightness of the running belt is adjusted by an adjusting spindle to shift said rear roller along said axis, a third support unit and said running belt will be synchronously shifted with the rear roller so as to maintain a clearance between said rear safety foot rest and said running belt.

2. The treadmill of claim 1 further comprises rear wheel seat, wherein said third support unit includes inserting members at both sides thereof for insertion into said rear wheel seats at both sides of said running bed, and wherein each of said inserting members has a pair of lateral arched grooves and a pair of longitudinal through holes through which a shaft of said rear roller and said adjusting spindle pass respectively, and wherein a connecting bar is used to be secured with said rear safety foot rest, and wherein said running bed includes an open groove disposed at both sides thereof respectively and corresponding to each of said inserting members of said support unit so that two positioning pins are received therein and screwed into a corresponding threaded hole for a firm fastening.

* * * * *